US007676053B2

(12) United States Patent
Nagaoka

(10) Patent No.: US 7,676,053 B2
(45) Date of Patent: Mar. 9, 2010

(54) ELECTRODYNAMIC LOUDSPEAKER

(75) Inventor: Satofumi Nagaoka, Neyagawa (JP)

(73) Assignee: Onkyo Corporation, Neyagawa-shi (JP)

( * ) Notice: Subject to any disclaimer, the term of this patent is extended or adjusted under 35 U.S.C. 154(b) by 1127 days.

(21) Appl. No.: 11/294,824

(22) Filed: Dec. 6, 2005

(65) Prior Publication Data

US 2006/0222200 A1 Oct. 5, 2006

(30) Foreign Application Priority Data

Mar. 30, 2005 (JP) ..... 2005-098800

(51) Int. Cl.
*H04R 25/00* (2006.01)

(52) U.S. Cl. ..... 381/414; 381/401; 381/421

(58) Field of Classification Search ..... 381/400, 381/401, 402, 410, 412, 414, 420, 421, 422, 381/407

See application file for complete search history.

(56) References Cited

U.S. PATENT DOCUMENTS

| | | | | |
|---|---|---|---|---|
| 4,160,133 | A * | 7/1979 | Wiik | 381/401 |
| 4,868,882 | A | 9/1989 | Ziegenberg et al. | |
| 5,452,366 | A | 9/1995 | Sakamoto et al. | |
| 5,828,767 | A * | 10/1998 | Button | 381/401 |
| 6,671,385 | B2 * | 12/2003 | Suzuki et al. | 381/412 |
| 2003/0031338 | A1 | 2/2003 | Suzuki et al. | |

FOREIGN PATENT DOCUMENTS

| | | |
|---|---|---|
| EP | 0 610 769 | 8/1994 |
| JP | 55-143898 | 11/1908 |
| JP | 58-152092 | 10/1983 |
| JP | 60-155296 | 10/1985 |
| JP | 63-85997 | 6/1988 |
| JP | 06-233379 | 8/1994 |
| JP | 6-71360 | 9/1994 |
| JP | 07-015796 | 1/1995 |
| JP | 2002-078083 | 3/2002 |

* cited by examiner

*Primary Examiner*—Huyen D Le
(74) *Attorney, Agent, or Firm*—Renner, Otto, Boisselle & Sklar, LLP

(57) ABSTRACT

An electrodynamic loudspeaker 1 includes a magnetic circuit 10 and a vibrator 20. The magnetic circuit 10 includes a magnet 11 and poles 12 and 13 adhering to the magnet 11. The vibrator 20 includes a coil bobbin 21 and voice coils 22 and 23 wound around and fixed to a portion of the coil bobbin 21 facing the poles 12 and 13. A magnetic member 30 is fixed to the coil bobbin 21 of the vibrator 20 at a position spaced apart from the voice coils 22 and 23. The magnetic member 30 is fixed at a position on the coil bobbin 21 so as to extend over an area facing the magnet 11 of the magnetic circuit 10.

8 Claims, 5 Drawing Sheets

ELECTRODYNAMIC LOUDSPEAKER

BACKGROUND OF THE INVENTION

1. Field of the Invention

The present invention relates to an electrodynamic loudspeaker for reproducing sound, and more particularly to an electrodynamic loudspeaker in which the weight of the magnetic circuit is reduced.

2. Description of the Related Art

In an electrodynamic loudspeaker, a vibrator including a diaphragm, a voice coil (including a coil bobbin and a voice coil wound around the coil bobbin) and a damper vibrates with respect to a magnetic circuit fixed to a frame, thereby reproducing sound. For example, with an inner-magnet-type magnetic circuit, the magnetic circuit includes a magnet, a pole and a yoke, with the voice coil of the vibrator being placed in the magnetic gap defined between the pole and the yoke. When a sound signal is applied through the voice coil, the vibrator receives a driving force therefrom and vibrates. The pole and the yoke forming the magnetic path of the magnetic circuit are made of a soft magnetic material such as iron, and the weight of the magnetic circuit accounts for a large portion of the total weight of the electrodynamic loudspeaker. In view of this, there have been conventional approaches to reduce the weight of an electrodynamic loudspeaker by improving the shape, etc., of the magnetic circuit thereof.

Loudspeakers with reduced weight include those using a repulsion-type magnetic circuit in which two magnets are placed on the upper and lower surfaces of a pole with their like poles facing each other, and those using a magnetic circuit in which a pole is placed on each of the two magnetic pole surfaces of a single magnet. In these magnetic circuits, the yoke for forming the magnetic path and the magnetic gap is omitted in order to reduce weight, thereby forming "open-type" magnetic circuits. The voice coil is placed so as to face the pole in which the magnetic flux is concentrated. Then, an open-type magnetic circuit with no yoke has a problem in that the magnetic flux density is decreased in the position of the voice coil. The distance over which magnetic force lines pass through the air increases, thus increasing the magnetic resistance of the magnetic path, and the magnetic force lines are no longer concentrated in the position of the voice coil, whereby the magnetic flux density in the position of the voice coil is further decreased. Thus, the reduction in the weight of the magnetic circuit results in a decrease in the efficiency of the electrodynamic loudspeaker, thereby failing to obtain desirable acoustic characteristics.

In view of such a problem resulting from a reduction in weight of a magnetic circuit, there is a conventional electrodynamic loudspeaker in which a thin-walled annular core of amorphous metal (magnetic body) is provided on the outer surface of a voice coil in an attempt to concentrate the magnetic force lines in the thin-walled annular core of amorphous metal (Japanese Patent Publication for Opposition No. 6-71360). In another conventional electrodynamic loudspeaker, a magnetic body such as iron is used as the core of a voice coil, and a conductive material such as copper or aluminum is adhered to the core by means of plating (Japanese Laid-Open Patent Publication No. 6-233379).

However, the conventional electrodynamic loudspeakers cannot realize both a reduction in weight and desirable acoustic characteristics. Specifically, if a magnetic body is provided on the outer surface of a voice coil, or if a magnetic body is used as the core of a voice coil, the voice coil, which is placed so as to face the pole in which magnetic force lines are concentrated, cannot sufficiently vibrate when a sound signal is applied through the voice coil because the magnetic body of the voice coil near the pole is grabbed by the magnetic force from the DC magnetic flux in the magnetic circuit. If the coil bobbin is not sufficiently strong, the magnetic force acting upon the magnetic body may cause the coil bobbin and the pole to be in contact with each other, which may result in a defective operation. As a result, with the conventional electrodynamic loudspeakers, a reduction in weight decreases the efficiency, thereby failing to realize desirable acoustic characteristics.

SUMMARY OF THE INVENTION

It is therefore an object of the present invention to provide an electrodynamic loudspeaker for reproducing sound, or more particularly, an electrodynamic loudspeaker in which the weight of the magnetic circuit is reduced. More specifically, an object of the present invention is to provide an electrodynamic loudspeaker capable of realizing both a reduction in weight and an improvement in efficiency, capable of realizing desirable acoustic characteristics, and capable of desirably reproducing sound.

An electrodynamic loudspeaker according to a preferred embodiment of the present invention includes a magnetic circuit including a magnet and a pole adhering to the magnet, and a vibrator including a coil bobbin and a voice coil wound around and fixed to a portion of the coil bobbin facing the pole, wherein a magnetic member is fixed to the coil bobbin of the vibrator at a position spaced apart from the voice coil.

Preferably, the magnetic member is fixed at a position on the coil bobbin so as to extend over an area facing the magnet of the magnetic circuit.

More preferably, the magnetic member is obtained by shaping a soft magnetic material into a generally annular form, the soft magnetic material being selected from the group consisting of an iron material, an electromagnetic soft iron material, a silicon steel material, an electromagnetic stainless steel material, an amorphous metal material, a Permalloy material, a Permendur material and a ferrite material.

Preferably, the magnetic member is obtained by shaping a magnetic sheet including a soft magnetic material and a resin into a generally annular form, the soft magnetic material being selected from the group consisting of an iron material, an electromagnetic soft iron material, a silicon steel material, an electromagnetic stainless steel material, an amorphous metal material, a Permalloy material, a Permendur material and a ferrite material.

More preferably, the magnetic circuit includes a first pole adhering to an upper surface of the magnet and a second pole adhering to a lower surface of the magnet, the vibrator includes a first voice coil wound around the first pole and a second voice coil wound around the second pole, and the magnetic member is placed at a position between the first voice coil and the second voice coil.

More preferably, the vibrator includes a diaphragm, and an inner edge of the diaphragm is fixed to the magnetic member placed at a position between the first voice coil and the second voice coil.

More preferably, the magnetic member is placed at a position above the first voice coil and at a position below the second voice coil.

More preferably, the magnetic circuit further includes a first sub-magnet adhering to an upper surface of the first pole and a second sub-magnet adhering to a lower surface of the second pole.

In an electrodynamic loudspeaker according to another preferred embodiment of the present invention, the magnetic circuit includes a first magnet adhering to an upper surface of the pole and a second magnet adhering to a lower surface of the pole, and the magnetic member is placed at a position above the voice coil and at a position below the voice coil.

An electrodynamic loudspeaker of the present invention includes a magnetic circuit including a magnet and a pole adhering to the magnet, and a vibrator including a coil bobbin and a voice coil wound around and fixed to a portion of the coil bobbin facing the pole, wherein a magnetic member is fixed to the coil bobbin of the vibrator at a position spaced apart from the voice coil. Therefore, with the electrodynamic loudspeaker of the present invention, even if an open-type magnetic circuit with no yoke is employed for reducing the weight, the magnetic force lines are concentrated by the magnetic member fixed to the coil bobbin, whereby it is possible to increase the magnetic flux density in the position of the voice coil facing the pole. Thus, even if the weight of the magnetic circuit is reduced, it is still possible to improve the efficiency of the electrodynamic loudspeaker and to obtain desirable acoustic characteristics.

The magnetic member is fixed to the coil bobbin at a position spaced apart from the voice coil. The magnetic member is preferably fixed at a position on the coil bobbin so as to extend over an area facing the magnet of the magnetic circuit. Thus, the magnetic member is not placed in contact with the outer surface of the voice coil facing the pole of the magnetic circuit, but is placed on the coil bobbin at a position spaced apart from the pole and the voice coil. The magnetic force acting upon the magnetic member decreases in inverse proportion to the distance to the pole. Therefore, the magnetic force that is received by the magnetic member on the coil bobbin from the DC magnetic flux in the magnetic circuit can be suppressed to be small. Thus, the vibrator can vibrate sufficiently when a sound signal is applied through the voice coil, and even if the coil bobbin is not sufficiently strong, there is no such problem that the coil bobbin and the pole are brought into contact with each other by the magnetic force acting upon the magnetic member, resulting in a defective operation. Therefore, with the electrodynamic loudspeaker of the present invention, it is possible to realize desirable acoustic characteristics and desirable sound reproduction.

The magnetic member may be obtained by shaping a soft magnetic material selected from the group consisting of an iron material, an electromagnetic soft iron material, a silicon steel material, an electromagnetic stainless steel material, an amorphous metal material, a Permalloy material, a Permendur material and a ferrite material into a generally annular form, or by shaping a magnetic sheet including such a soft magnetic material and a resin into a generally annular form. It is only required that the magnetic member includes a soft magnetic material having a high magnetic permeability for concentrating the magnetic force lines in an open-type magnetic circuit. The magnetic member, which is fixed to the coil bobbin forming a part of the vibrator, is preferably light and thin. In addition to a magnetic sheet as set forth above, the magnetic member may use a soft magnetic material processed into a perforated metal or fine fiber form. Thus, with the electrodynamic loudspeaker of the present invention, a highly improved efficiency can be realized even if a magnetic circuit with a reduced weight is employed.

Specifically, in the case of a so-called "2-voice coil type" electrodynamic loudspeaker in which the magnetic circuit includes a first pole adhering to an upper surface of the magnet and a second pole adhering to a lower surface of the magnet, and the vibrator includes a first voice coil wound around the first pole and a second voice coil wound around the second pole, the magnetic member is placed at a position on the coil bobbin between the first voice coil and the second voice coil. The vibrator may include a cone-shaped or flat diaphragm, with an inner edge of the diaphragm being fixed to the magnetic member placed at a position between the first voice coil and the second voice coil. The magnetic member concentrates the magnetic force lines and increases the magnetic flux density in the position of the first voice coil and the second voice coil, while the magnetic member is fixed at a position spaced apart from the first pole and the second pole in which the magnetic force lines are concentrated, whereby there is little influence from the magnetic force from the DC magnetic flux, thus allowing the vibrator to vibrate. Moreover, since the magnetic member is fixed at a position so as to extend over an area facing the magnet interposed between the first pole and the second pole of the magnetic circuit, the magnetic member is held coaxially at a well-balanced position with respect to the magnetic circuit by the magnetic force from the DC magnetic flux from each of the first pole and the second pole. Therefore, the resting position of the voice coil of the vibrator is better defined with respect to the pole of the magnetic circuit, thereby stabilizing the operation of the vibrator including the diaphragm fixed to the magnetic member and thus realizing an electrodynamic loudspeaker being highly efficient and capable of desirably reproducing sound.

In the case of a 2-voice coil type electrodynamic loudspeaker, the magnetic member may more preferably be placed at a position above the first voice coil and at a position below the second voice coil. With the provision of these magnetic members on the coil bobbin, it is possible to increase the magnetic flux density in the position of the first voice coil and the second voice coil, thus realizing a more efficient electrodynamic loudspeaker. The magnetic circuit may further include a first sub-magnet adhering to an upper surface of the first pole and a second sub-magnet adhering to a lower surface of the second pole, thus forming a repulsion magnetic field across the first pole and the second pole and further increasing the magnetic flux density in the position of the first voice coil and the second voice coil. It is possible to realize an electrodynamic loudspeaker with more desirable acoustic characteristics and more desirable sound reproduction.

Also in the case of a so-called "1-voice coil type" electrodynamic loudspeaker, if the magnetic circuit is a repulsion-type magnetic circuit including a first magnet adhering to an upper surface of the pole and a second magnet adhering to a lower surface of the pole, magnetic members can be fixed to the coil bobbin of the vibrator at positions spaced apart from the voice coil, i.e., one at a position above the voice coil and another at a position below the voice coil. As a result, even if the yoke of the magnetic circuit is omitted in order to reduce the weight, it is possible to realize an electrodynamic loudspeaker with a reduced weight capable of desirably reproducing sound. The magnetic members placed above and below the voice coil concentrate the magnetic force lines, whereby it is possible to increase the magnetic flux density in the position of the voice coil, and the magnetic members are fixed at positions spaced apart from the pole in which the magnetic force lines are concentrated, whereby there is little influence from the magnetic force from the DC magnetic flux, thus allowing the vibrator to vibrate. Moreover, the voice coil of the vibrator is held coaxially at a well-balanced position so as to face the pole by the magnetic force from the DC magnetic flux acting upon the magnetic members placed above and below the voice coil, whereby the electrodynamic loudspeaker of the present invention realizes a stable operation and desirable acoustic characteristics.

DETAILED DESCRIPTION OF THE PREFERRED EMBODIMENTS

While preferred embodiments of the present invention will now be described with reference to the drawings, it is understood that the present invention is not limited thereto.

Embodiment 1

Figure 1:
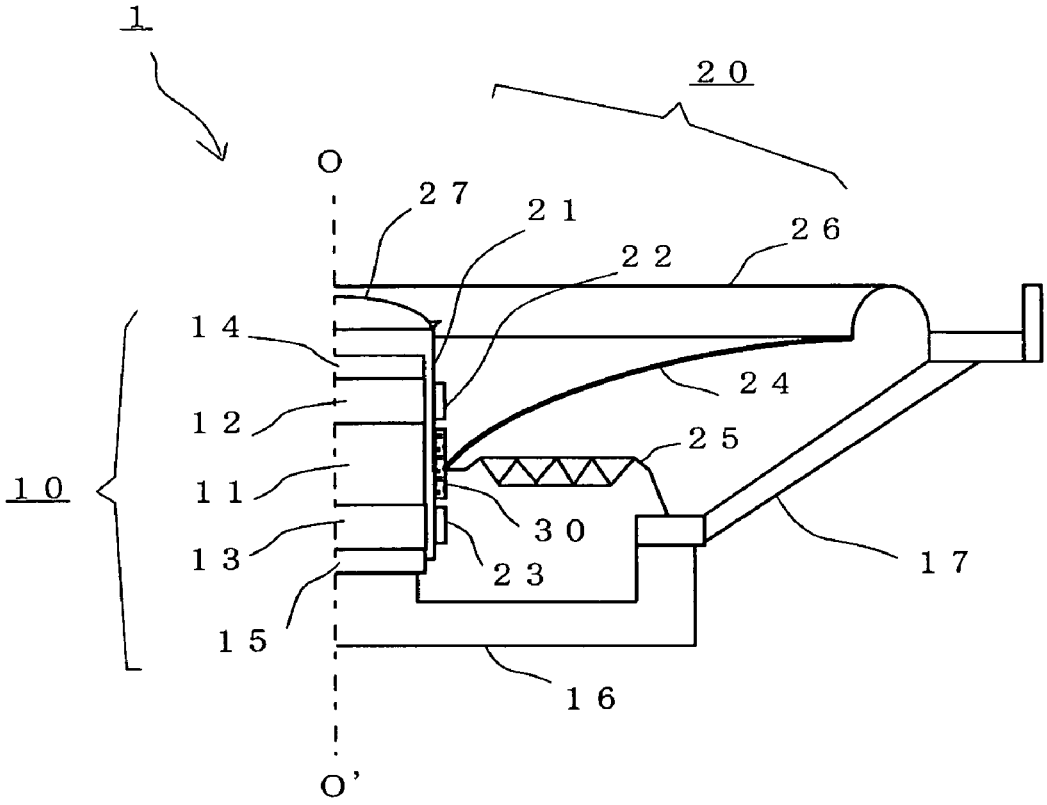
FIG. 1 is a schematic cross-sectional view showing an electrodynamic loudspeaker 1 according to a preferred embodiment of the present invention (Embodiment 1).

FIG. 1 is a schematic cross-sectional view showing an electrodynamic loudspeaker 1 according to a preferred embodiment of the present invention, while omitting the left half of the loudspeaker being generally in axial symmetry about the center axis O-O'. The electrodynamic loudspeaker 1 of the present embodiment is of a so-called "2-voice coil type" and includes a magnetic circuit 10 including a magnet and a vibrator 20 including two voice coils, which are fixed to a base 16 and a frame 17. The total weight of the electrodynamic loudspeaker is reduced by reducing the weight of the magnetic circuit 10.

Specifically, the magnetic circuit 10 includes a magnet 11, a first pole 12 adhering to the upper surface of the magnet 11, a second pole 13 adhering to the lower surface of the magnet 11, a magnet 14 adhering to the upper surface of the first pole 12, and a magnet 15 adhering to the lower surface of the second pole 13. Thus, the magnetic circuit 10 is an open-type magnetic circuit, which does not include a yoke of a magnetic material forming a magnetic path such as those seen in inner-magnet-type magnetic circuits or outer-magnet-type magnetic circuits. Avoiding the use of a yoke of iron having a high specific gravity realizes a reduction in weight of the magnetic circuit 10. The magnets 11 and 14 are placed on the upper and lower surfaces of the first pole 12 with their like poles facing each other, thus forming a repulsion magnetic field S1 (not shown) across the side surface of the first pole 12. Similarly, the magnets 11 and 15 are placed on the upper and lower surfaces of the second pole 13 with their like poles facing each other, thus forming a repulsion magnetic field S2 (not shown) across the side surface of the second pole 13. Therefore, the orientation of the magnetic force lines in the repulsion magnetic field S1 is opposite to that in the repulsion magnetic field S2, and the DC magnetic force lines in the magnetic circuit 10 are formed so as to connect together the repulsion magnetic fields S1 and S2. In the present embodiment, the magnets 11, 14 and 15 are a neodymium magnet.

The vibrator 20 includes a coil bobbin 21, a first voice coil 22, a second voice coil 23, a cone diaphragm 24, a damper 25, an edge 26, a dust cap 27, and a magnetic member 30. The first voice coil 22 is wound around and fixed to a portion of the coil bobbin 21 facing the first pole 12, and the second voice coil 23 is wound around and fixed to a portion of the coil bobbin 21 facing the second pole 13. Therefore, when a sound signal current is supplied to the first voice coil 22, a driving force F1 is produced from the repulsion magnetic field S1, and when a sound signal current is supplied to the second voice coil 23, a driving force F2 is produced from the repulsion magnetic field S2, whereby the vibrator 20 is vibrated by the total driving force F (=F1+F2). Specifically, the driving force F vibrates the cone diaphragm 24, which is supported coaxially by the damper 25 and the edge 26 of the vibrator 20 at the inner edge and the outer edge thereof, and the dust cap 27 capping one end of the coil bobbin 21, thereby reproducing sound. Since the orientation of the repulsion magnetic field S1 is opposite to that of the repulsion magnetic field S2, the sound signal currents flowing through the first voice coil 22 and the second voice coil 23 are set to be in opposite directions.

In the vibrator 20, the magnetic member 30 is fixed to the coil bobbin 21 at a position between the first voice coil 22 and the second voice coil 23 spaced apart from these voice coils. The magnetic member 30 is a member obtained by shaping a magnetic sheet including a soft magnetic material and a resin into an annular form. Specifically, a thin, flexible electromagnetic shield member that functions as a noise suppression sheet, a magnetic sheet or a radio wave absorber (e.g., noise suppression sheets available from TDK Corporation, including IRL, IRJ, IVM, IRB and IRE materials; thickness: 0.05 mm to 1.00 mm) is fixed to the outer surface of the coil bobbin 21 with an adhesive. Since the magnetic member 30 has a magnetic permeability higher than that of the air (i.e., a high relative magnetic permeability), the DC magnetic force lines in the magnetic circuit 10 are concentrated at the magnetic member 30, thereby increasing the magnetic flux density in the position of the first voice coil 22 and the second voice coil 23.

Figure 2:
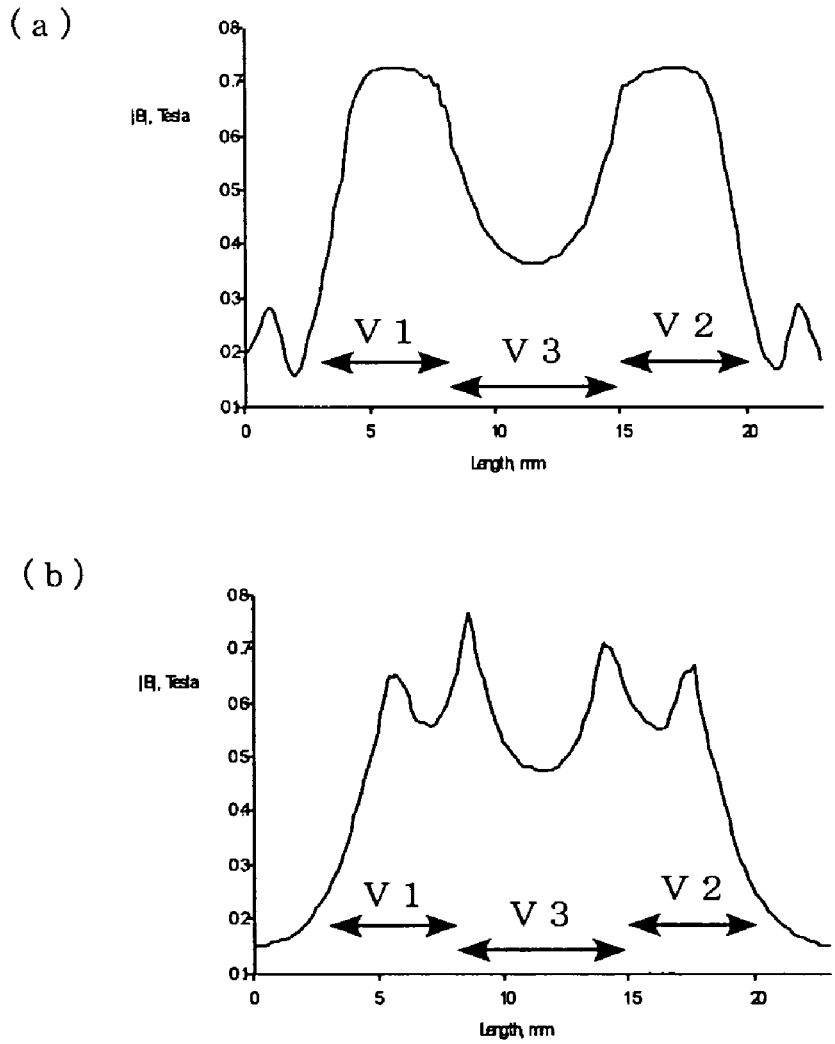
FIGS. 2A and 2B are graphs each showing a magnetic flux density distribution of a magnetic field formed by a magnetic circuit 10.

FIGS. 2A and 2B are graphs each showing the magnetic flux density distribution of the magnetic field formed by the magnetic circuit in the position of each voice coil, wherein the horizontal axis represents the axial distance along the coil bobbin of the vibrating system, and the vertical axis represents the absolute value of the magnetic flux density. FIG. 2A is for the electrodynamic loudspeaker 1 of the present invention, in which the magnetic member 30 is fixed to the coil bobbin 21 having a diameter $\phi$ of 25 mm via an adhesive. The magnetic member 30 is obtained by shaping a magnetic sheet having a width of 5.0 mm and a thickness of 0.05 mm into a complete annular form. The first voice coil 22 and the second voice coil 23 are each wound around over a width of 5.0 mm with a 0.5 mm interval between each voice coil and the magnetic member 30. The magnet 11 has a thickness of 7.0 mm, the first pole 12 and the second pole 13 have a thickness of 4.0 mm, and the magnets 14 and 15 have a thickness of 2.0 mm. FIG. 2B is for a reference electrodynamic loudspeaker including a conventional open-type magnetic circuit in which the magnetic circuit and the vibrator are similar to the magnetic circuit 10 and the vibrator 20 of the present invention except that the magnetic member 30 is not provided.

The electrodynamic loudspeaker 1 of the present invention provides a stable increase in the magnetic flux density over an area V1 of the first voice coil 22 wound around the first pole 12 and an area V2 of the second voice coil 23 wound around the second pole 13. The magnetic flux density drops in an area V3 (an intermediate area between the area V1 and the area V2) where the DC magnetic force lines do not act as the driving force F between the first voice coil 22 and the second voice coil 23. In contrast, with the reference electrodynamic loudspeaker, the magnetic flux density distribution in the area V1 and that in the area V2 are disturbed, and the magnetic flux density in the area V3 between the area V1 and the area V2 is higher. Thus, with the electrodynamic loudspeaker 1 of the present invention, the magnetic flux density distribution in the position of each voice coil can be increased, thereby improving the efficiency, even though the weight thereof is reduced by employing an open-type magnetic circuit for the magnetic circuit 10.

Figure 3:
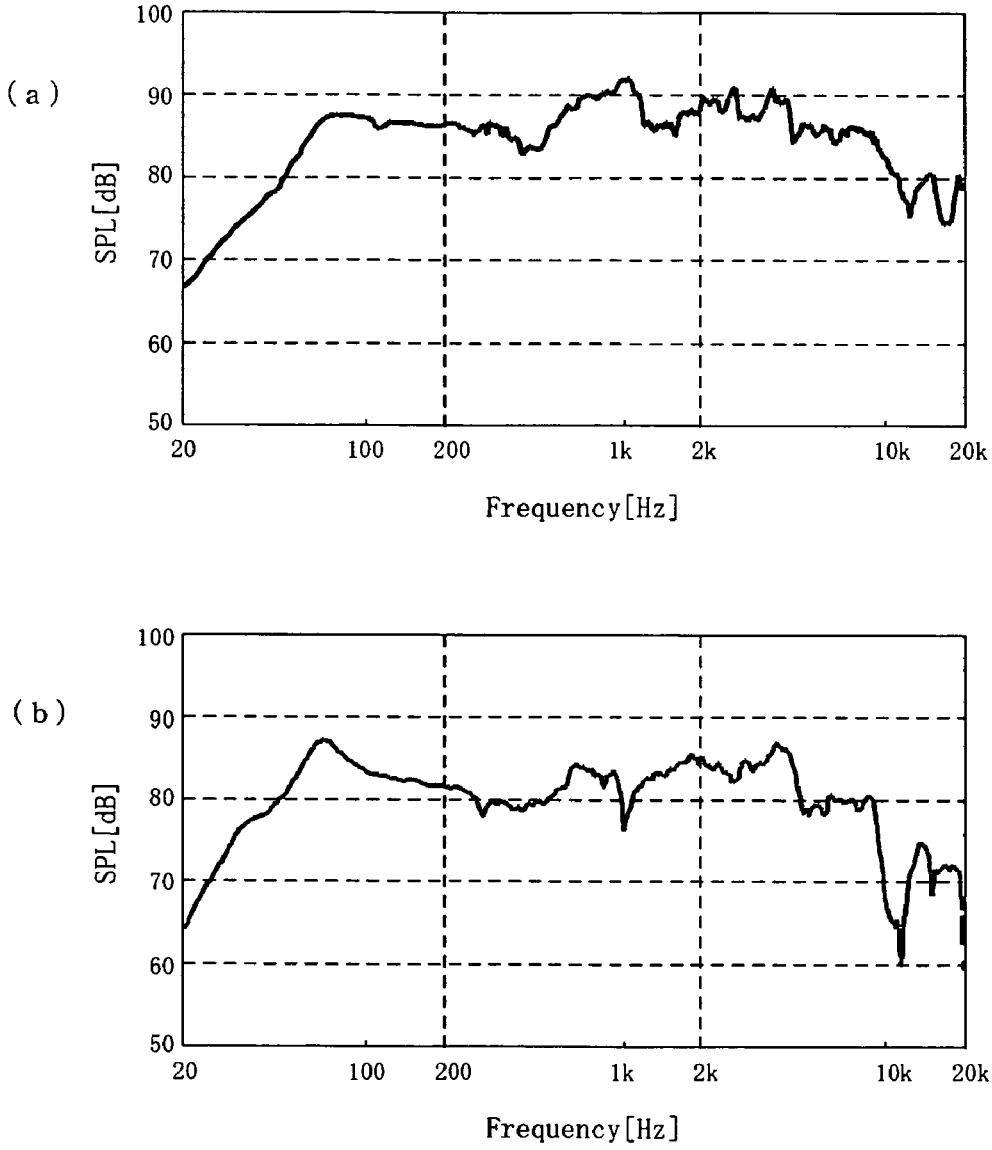
FIGS. 3A and 3B are graphs each showing sound pressure-frequency characteristics of the electrodynamic loudspeaker 1.

FIGS. 3A and 3B are graphs each showing the sound pressure-frequency characteristics for a 1 W input measured at a 1 m distance along the axis of the electrodynamic loudspeaker, wherein FIG. 3A is for the electrodynamic loudspeaker 1 of the present invention, and FIG. 3B is for the reference electrodynamic loudspeaker. As shown in FIGS. 3A and 3B, the electrodynamic loudspeaker 1 of the present invention gives a sound pressure level of about 88 dB, about 4 dB higher than that of the reference electrodynamic loudspeaker (about 84 dB), reflecting the increase in the magnetic flux density distribution in the position of each voice coil for the electrodynamic loudspeaker 1 of the present invention. Therefore, the electrodynamic loudspeaker 1 of the present invention is an electrodynamic loudspeaker that is highly efficient and capable of desirably reproducing sound.

The magnetic member 30 has a width of 5.0 mm, and is fixed at a position so as to extend over an area facing the 7.0 mm thick magnet 11 interposed between the first pole 12 and the second pole 13 of the magnetic circuit 10. Since the magnetic member 30 is not placed near the outer surface of the first voice coil 22 and the second voice coil 23, it is possible to avoid the problem that the magnetic member 30 cannot sufficiently vibrate by being grabbed by a strong magnetic force from the DC magnetic flux and the problem that there may occur a defective operation. The magnetic member 30 is only required to be spaced apart from the first voice coil 22 and the second voice coil 23, and the distance therebetween may be very little as long as they do not have an overlap. The magnetic member 30 is held coaxially at a well-balanced position with respect to the magnetic circuit 10 due to the magnetic force from the DC magnetic flux from each of the first pole 12 and the second pole 13. As a result, the resting positions of the first voice coil 22 and the second voice coil 23 are better defined with respect to the first pole 12 and the second pole 13 of the magnetic circuit 10, thereby stabilizing the operation of the vibrator 20 and thus realizing the electrodynamic loudspeaker 1 being highly efficient and capable of desirably reproducing sound.

The cone diaphragm 24 of the vibrator 20 has its inner edge fixed to the magnetic member 30 placed between the first voice coil 22 and the second voice coil 23. Since the driving force F of the vibrator 20 is the sum of the driving force F1 in the first voice coil 22 and the driving force F2 in the second voice coil 23, the driving force can be more efficiently transmitted to the cone diaphragm 24 by fixing the inner edge of the cone diaphragm 24 to the magnetic member 30 placed in the middle between the voice coils. Thus, the electrodynamic loudspeaker 1 with a desirable sound quality can be realized. The damper 25 of the vibrator 20 also has its inner edge fixed to the magnetic member 30. Since the damper 25 supports the magnetic member 30, which is close to the center of gravity of the vibrator 20, the electrodynamic loudspeaker 1 with a more stable operation can be realized.

While the magnetic member 30 is obtained by shaping a magnetic sheet including a soft magnetic material and a resin into an annular form in the present embodiment, it may be obtained by shaping a soft magnetic material such as an iron material, an electromagnetic soft iron material, a silicon steel material, an electromagnetic stainless steel material, an amorphous metal material, a Permalloy material, a Permendur material or a ferrite material, for example, into a generally annular (ring) form. The annular or ring shape of the magnetic member 30 does not have to be a closed shape, but may alternatively be a set of divided arc-shaped members. The present invention is not limited to magnetic materials as listed above as long as the magnetic member 30 contains a soft magnetic material having a high magnetic permeability for concentrating the DC magnetic force lines in the open-type magnetic circuit 10. The magnetic member 30, which is fixed to the coil bobbin 21 forming a part of the vibrator 20, is preferably light and thin. The magnetic member 30 may be a soft magnetic material processed into a perforated metal or fine fiber form. By appropriately determining the material, shape and weight of the magnetic member 30, the electrodynamic loudspeaker 1 can have both a reduced weight and an improved efficiency, thus realizing desirable acoustic characteristics and desirable sound reproduction. The magnetic member 30 of the present embodiment weighs about 0.6 g, and a preferred weight range of the magnetic member 30 is about 0.1 g to about 2.0 g. The magnetic member 30 may be used as a weight ring for adjusting the lowest resonant frequency f0, which defines the lowest reproducible frequency of the electrodynamic loudspeaker 1.

The magnets 11, 14 and 15 may be a rare earth magnet, such as an alnico magnet or a neodymium magnet, used in an inner-magnet-type magnetic circuit or a repulsion-type magnetic circuit. It is understood that they may alternatively be a ferrite magnet or a bonded magnet made of a resin and a powdered magnet material. While it is preferred that a non-magnetic resin material that does not influence the DC magnetic force lines in the open-type magnetic circuit 10 is used for the base 16 for securing the magnetic circuit 10 and the frame 17 for supporting the vibrator 20, a soft magnetic material such as iron may alternatively be used in order to reduce the magnetic flux leakage. Alternatively, a metal material such as an aluminum alloy may be used for the base 16 in order to strongly secure the magnetic circuit 10 or to dissipate heat from the magnetic circuit 10. Moreover, the cone diaphragm 24 is not limited to a cone shape, but may alternatively be a flat diaphragm.

Embodiment 2

Figure 4:
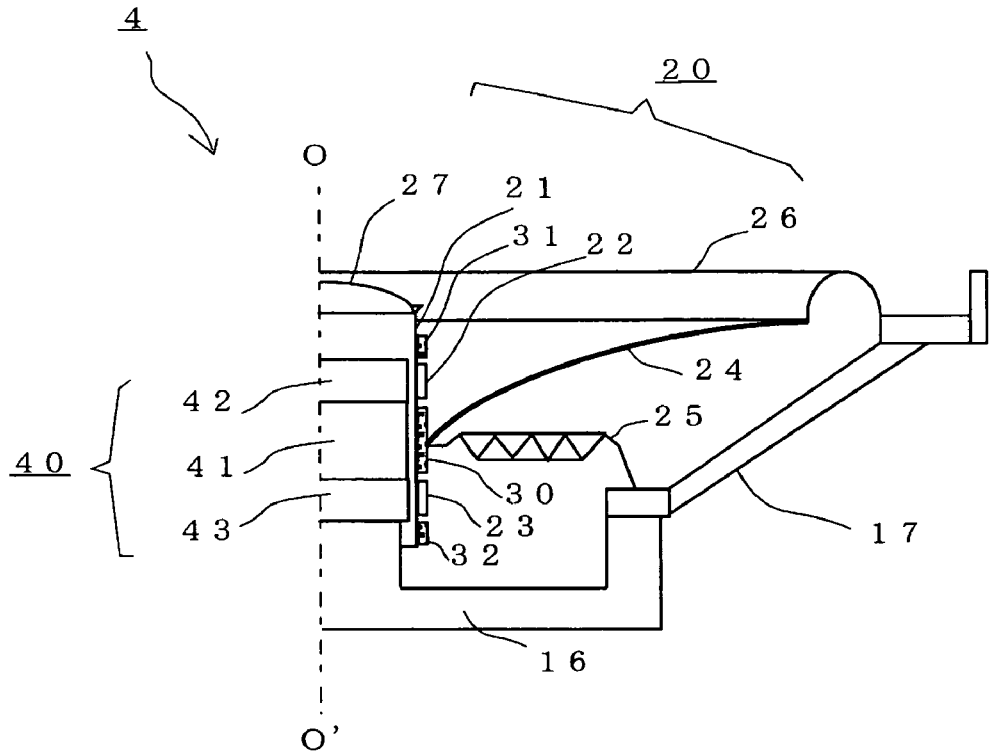
FIG. 4 is a schematic cross-sectional view showing an electrodynamic loudspeaker 4 according to another preferred embodiment of the present invention (Embodiment 2).

FIG. 4 is a schematic cross-sectional view showing an electrodynamic loudspeaker 4 according to another preferred embodiment of the present invention, while omitting the left half of the loudspeaker being generally in axial symmetry about the center axis O-O'. The electrodynamic loudspeaker 4 of the present embodiment includes a magnetic circuit 40 including a magnet and the vibrator 20 including two voice coils, in which the total weight of the electrodynamic loudspeaker is reduced by reducing the weight of the magnetic circuit 40. Like elements to those of the electrodynamic loudspeaker 1 of Embodiment 1, e.g., the base 16, the frame 17 and the cone diaphragm 24 of the vibrator 20, will not be further described below.

Specifically, the magnetic circuit 40 includes a magnet 41, a first pole 42 adhering to the upper surface of the magnet 41, and a second pole 43 adhering to the lower surface of the magnet 41. Thus, the magnetic circuit 40 is also an open-type magnetic circuit, which does not include a yoke of a magnetic material. In addition to avoiding the use of a yoke of iron having a high specific gravity, the magnets 14 and 15 used in the magnetic circuit 10 of Embodiment 1 for forming a repulsion magnetic field are also omitted, thereby realizing a further reduction in the weight of the magnetic circuit. In the present embodiment, the magnet 41 is a neodymium magnet.

The vibrator 20 includes the coil bobbin 21, the first voice coil 22, the second voice coil 23, the cone diaphragm 24, the damper 25, the edge 26, the dust cap 27, the magnetic member 30, a first sub-magnetic member 31, and a second sub-magnetic member 32. The first sub-magnetic member 31 and the second sub-magnetic member 32 are each a member obtained by shaping a magnetic sheet including a soft magnetic material and a resin and having the same thickness as that of the magnetic member 30 into an annular form. The first sub-magnetic member 31 is fixed to the outer surface of the coil bobbin 21 via an adhesive at a position above and spaced apart from the first voice coil 22. The second sub-magnetic member 32 is fixed to the outer surface of the coil bobbin 21 via an adhesive at a position below and spaced apart from the second voice coil 23.

The provision of the magnetic member 30 in the middle between the first voice coil 22 and the second voice coil 23 increases the magnetic flux density in the position of the first voice coil 22 and the second voice coil 23, and the provision of the first sub-magnetic member 31 and the second sub-magnetic member 32 further increases the magnetic flux density. In an open-type magnetic circuit, where the DC magnetic force lines pass through the air having a low magnetic permeability, the magnetic resistance is high, whereby DC magnetic force lines leak near the first pole 42 and the second pole 43, thus forming a short loop. However, since the first sub-magnetic member 31 and the second sub-magnetic member 32 have a magnetic permeability higher than that of the air (i.e., a higher relative magnetic permeability), the leaked DC magnetic force lines are also concentrated in the first sub-magnetic member 31 and the second sub-magnetic member 32. As a result, the magnetic flux density is increased in the position of the first voice coil 22 and the second voice coil 23, whereby the electrodynamic loudspeaker 4 can have a light weight and a high efficiency.

The first sub-magnetic member 31 and the second sub-magnetic member 32 may be made from a magnetic sheet of the same thickness as that of the magnetic member 30, or a magnetic sheet of a different thickness or a different material. It is understood that it is possible to use a magnetic member obtained by shaping any suitable soft magnetic material into a generally annular form. As with the magnetic circuit 10 of Embodiment 1, the magnetic circuit 40 may include one or two sub-magnets forming a repulsion magnetic field. In such a case, the first sub-magnetic member 31 and the second sub-magnetic member 32 may each be fixed at a position so as to extend over an area facing the corresponding one of these sub-magnets. As the magnetic flux density is increased in the position of the first voice coil 22 and the second voice coil 23, it is possible to realize the electrodynamic loudspeaker 4 being highly efficient and capable of desirably reproducing sound.

Embodiment 3

Figure 5:
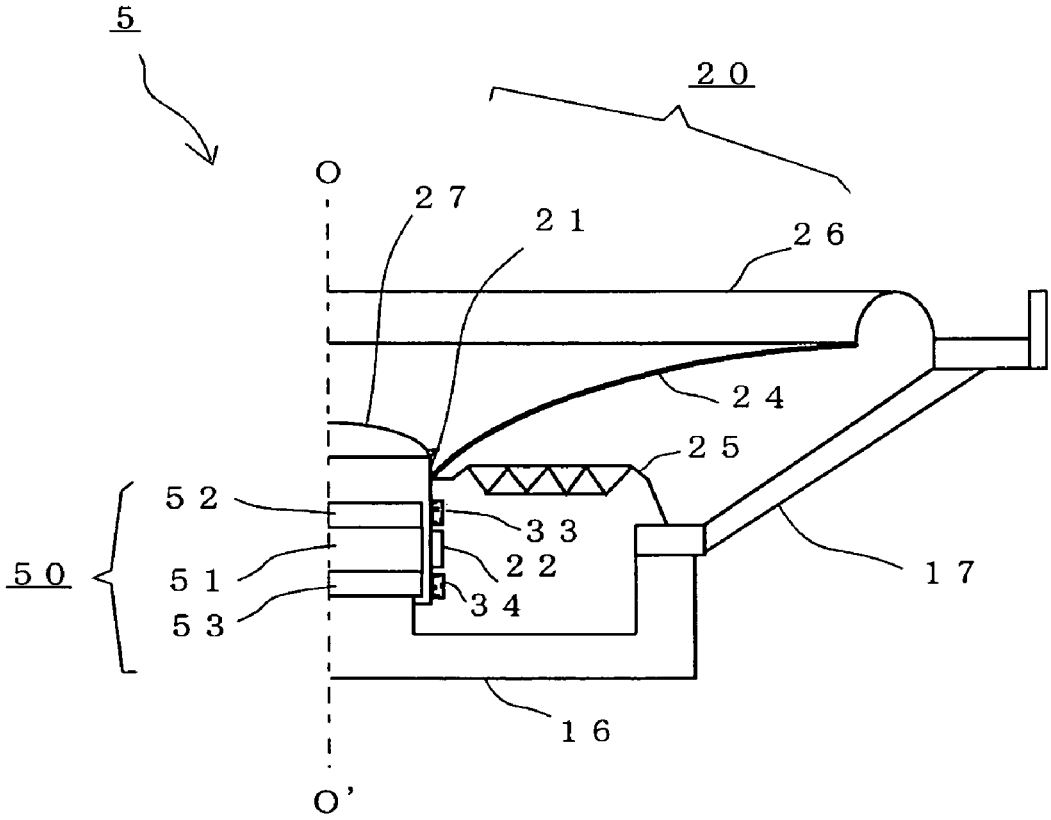
FIG. 5 is a schematic cross-sectional view showing an electrodynamic loudspeaker 5 according to another preferred embodiment of the present invention (Embodiment 3).

FIG. 5 is a schematic cross-sectional view showing an electrodynamic loudspeaker 5 according to another preferred embodiment of the present invention, while omitting the left half of the loudspeaker being generally in axial symmetry about the center axis O-O'. The electrodynamic loudspeaker 5 of the present embodiment includes a repulsion-type magnetic circuit 50 including two magnets, and the vibrator 20 including one voice coil, in which the total weight of the electrodynamic loudspeaker is reduced by reducing the weight of the repulsion-type magnetic circuit 50. As in Embodiment 2, like elements to those of the electrodynamic loudspeaker 1 of Embodiment 1, e.g., the base 16, the frame 17 and the cone diaphragm 24 of the vibrator 20, will not be further described below.

Specifically, the repulsion-type magnetic circuit 50 includes a pole 51, a first magnet 52 adhering to the upper surface of the pole 51, and a second magnet 53 adhering to the lower surface of the pole 51. Thus, the repulsion-type magnetic circuit 50 is also an open-type magnetic circuit, which does not include a yoke of a magnetic material. In addition to avoiding the use of a yoke of iron having a high specific gravity, efficient rare earth magnets (neodymium magnets in the present embodiment) are used for the first magnet 52 and the second magnet 53, thereby realizing a magnetic circuit that is lighter than the magnetic circuit 10 of Embodiment 1 and the magnetic circuit 40 of Embodiment 2. Thus, the total weight of the electrodynamic loudspeaker 4 is further reduced.

The first magnet 52 and the second magnet 53 are placed on the upper and lower surfaces of the pole 51 with their like poles facing each other, thus forming a repulsion magnetic field S5 (not shown) across the side surface of the pole 51. The voice coil 22 of the vibrator 20 is wound around and fixed to a portion of the coil bobbin 21 facing the pole 51. Therefore, when a sound signal current is supplied to the voice coil 22, the vibrator 20 is vibrated by a driving force F produced from the repulsion magnetic field S5. As a result, the cone diaphragm 24 whose inner edge is fixed to the coil bobbin 21 vibrates, thereby reproducing sound.

Magnetic members are placed at positions above and below the voice coil 22 wound around the coil bobbin 21 and spaced apart from the voice coil 22. Specifically, an upper magnetic member 33 is fixed to the outer surface of the coil bobbin 21 via an adhesive at a position above and spaced apart from the voice coil 22, and a lower magnetic member 34 is fixed to the outer surface of the coil bobbin 21 via an adhesive at a position below and spaced apart from the voice coil 22. The upper magnetic member 33 and the lower magnetic member 34 may be magnetic members as described in Embodiment 1 or Embodiment 2. Preferably, The upper magnetic member 33 and the lower magnetic member 34 are obtained by shaping a magnetic sheet including a soft magnetic material and a resin into an annular form. Since the upper magnetic member 33 and the lower magnetic member 34 are fixed to the coil bobbin 21 at positions spaced apart from the voice coil 22, the magnetic flux density is increased in the position of the voice coil 22, whereby the electrodynamic loudspeaker 5 can have a light weight and a high efficiency. Moreover, since the upper magnetic member 33 and the lower magnetic member 34 are not placed near the outer surface of the voice coil 22, it is possible to avoid the problem that the upper magnetic member 33 and the lower magnetic member 34 cannot sufficiently vibrate by being grabbed by a strong magnetic force from the DC magnetic flux and the problem that there may occur a defective operation.

It is preferred that the upper magnetic member 33 and the lower magnetic member 34 are magnetic members of the same material, shape and weight, and it is preferred that they are substantially at an equal distance from the voice coil 22. Then, since the magnetic force from the DC magnetic flux from the pole 51 acts upon each of the upper magnetic member 33 and the lower magnetic member 34, the vibrator 20 is held coaxially at a well-balanced position with respect to the repulsion-type magnetic circuit 50. The resting position of the voice coil 22 is better defined with respect to the pole 51 of the repulsion-type magnetic circuit 50, thereby stabilizing the operation of the vibrator 20 and thus realizing the electrodynamic loudspeaker 5 being highly efficient and capable of desirably reproducing sound.

The present invention is applicable in various applications such as loudspeakers used in portable electronic devices where a reduction in weight is desired, loudspeakers used in on-vehicle audio devices, and electrodynamic loudspeakers used in stereo reproduction or multi-channel surround reproduction systems for household use. The present invention is not limited to electrodynamic loudspeakers, but may also be applicable in electrodynamic microphones.

What is claimed is:

1. An electrodynamic loudspeaker, comprising:

a magnetic circuit including a magnet, a first pole adhering to an upper surface of the magnet, and a second pole adhering to a lower surface of the magnet; and a vibrator including a diaphragm, a coil bobbin, a first voice coil wound around and fixed to a portion of the coil bobbin facing the first pole, and a second voice coil wound around and fixed to a portion of the coil bobbin facing the second pole, wherein a magnetic member is fixed to the coil bobbin of the vibrator at a position between the first voice coil and the second voice coil.

2. The electrodynamic loudspeaker according to claim 1, wherein the magnetic member is obtained by shaping a soft magnetic material into a generally annular form, the soft magnetic material being selected from the group consisting of an iron material, an electromagnetic soft iron material, a silicon steel material, an electromagnetic stainless steel material, an amorphous metal material, a Permalloy material, a Permendur material and a ferrite material.

3. The electrodynamic loudspeaker according to claim 2, the magnetic member is also placed at a position above the first voice coil and at a position below the second voice coil.

4. The electrodynamic loudspeaker according to claim 2, wherein the magnetic circuit includes a first sub-magnet adhering to an upper surface of the first pole and a second sub-magnet adhering to a lower surface of the second pole.

5. The electrodynamic loudspeaker according to claim 1, wherein the magnetic member is obtained by shaping a magnetic sheet including a soft magnetic material and a resin into a generally annular form, the soft magnetic material being selected from the group consisting of an iron material, an electromagnetic soft iron material, a silicon steel material, an electromagnetic stainless steel material, an amorphous metal material, a Permalloy material, a Permendur material and a ferrite material.

6. The electrodynamic loudspeaker according to claim 5, wherein the magnetic member is also placed at a position above the first voice coil and at a position below the second voice coil.

7. The electrodynamic loudspeaker according to claim 5, wherein the magnetic circuit includes a first sub-magnet adhering to an upper surface of the first pole and a second sub-magnet adhering to a lower surface of the second pole.

8. The electrodynamic loudspeaker according to claim 1, wherein the vibrator includes a diaphragm, and an inner edge of the diaphragm is fixed to the magnetic member.

* * * * *